United States Patent [19]

Oldson

[11] Patent Number: 4,592,548

[45] Date of Patent: Jun. 3, 1986

[54] ECONOMICAL BOWLING CONTROL SYSTEM

[76] Inventor: Russell K. Oldson, 4700 N. Sierra Way, #207, San Bernardino, Calif. 92404

[21] Appl. No.: 673,413

[22] Filed: Nov. 20, 1984

[51] Int. Cl.[4] ..... A63D 5/00

[52] U.S. Cl. ..... 273/43 A

[58] Field of Search ..... 273/43 R, 43 A, 54 R; 318/484; 361/23

[56] References Cited

U.S. PATENT DOCUMENTS

| | | | |
|---|---|---|---|
| 522,851 | 7/1894 | Peirce | 361/23 X |
| 991,787 | 5/1911 | Kouwenhoven et al. | 361/23 |
| 3,470,553 | 9/1969 | Hyde | 273/54 R X |
| 3,609,455 | 9/1971 | Salihi et al. | 361/23 |
| 3,731,149 | 5/1979 | Sherman et al. | 361/23 X |
| 3,889,947 | 6/1975 | Short | 273/43 A |
| 4,151,993 | 5/1979 | Payne et al. | 273/43 A |
| 4,200,826 | 4/1980 | Calusio | 318/484 |
| 4,275,884 | 6/1981 | Smith | 273/54 R X |

*Primary Examiner*—Anton O. Oechsle

*Attorney, Agent, or Firm*—Poms, Smith, Lande & Rose

[57] ABSTRACT

A simplified, low voltage control circuit operates the motor for a pinsetter intermittently, instead of having the motor operate continuously. The low voltage system is mounted in the existing electrical control box for the pinsetter. The control circuit includes the relay for turning the high voltage motor circuit on or off, and a low voltage input electromagnet coil for the relay. To operate the motor control relay, circuitry is coupled to the existing 24 volt (low voltage) circuit of the pinsetter, and the control circuit includes a switch coupled to the clutch between the motor and the pinspotter mechanism, and a second switch which is coupled to the deck filler mechanism to indicate when the pinspotter deck is full. In addition, a delay circuit is provided to maintain the relay energized and the motor turned on, for a brief period of time until the system completes its cycle after an indication is given that the pinspotter deck is full. An additional bypass switch is provided to energize the relay and turn the motor on regardless of the state of the clutch or the deck.

7 Claims, 9 Drawing Figures

ECONOMICAL BOWLING CONTROL SYSTEM

FIELD OF THE INVENTION

This invention relates to control circuits for operating the motor for an automatic pinsetter intermittently, instead of having it run continuously.

BACKGROUND OF THE INVENTION

It has previously been proposed to operate the motor for an automatic pinsetter intermittently, and one such proposed arrangement was until recently commercially available. However, this system operates on the high voltage circuit level of the motor, and requires an extra junction box of substantial size, and heavy power cables, so that the retail cost of the system was several hundred dollars. In addition, the system caused motor burn-out within a relatively short time after the system was installed. Accordingly, rather than saving money by operating the motor intermittently, there was not only a substantial initial cost for the system, but the additional cost of burned-out motors resulting from the use of this supposed economizer, has caused the system to be much more expensive than the energy which is saved. Other similar systems have been proposed, but they have been no more effective than that of the above described system.

Accordingly, a principal object of the present invention is to provide an inexpensive and effective control circuit for the intermittent operation of the pinsetter motor, and a system which will not burn out the pinsetter motor.

In accordance with the present invention, the existing low voltage circuitry in the automatic pinsetter is employed to power a low voltage control circuit and relay, with the output contacts of the electromagnetic relay being employed to operate the high voltage motor circuit. The control circuit includes three parallel switches to operate the relay, with one being energized by the operation of the clutch to initiate operation of the motor, the second being operated by the deck filling mechanism to maintain the relay energized as long as the deck for holding pins associated with the pinspotter is not completely filled, and a third mechanic's bypass switch so that the motor may be turned on regardless of the state of the clutch or the deck. A delay circuit is included to maintain the relay closed and the pinsetter motor operating for a few seconds after the full deck switch has opened, so that the apparatus may complete its cycle.

In accordance with a feature of the invention, the system may be mounted directly within the existing electrical box of the automatic pinsetter and only employs a few low voltage components, so that the cost of the installation is a fraction of the system described above.

With regard to the details of the low voltage circuit, it may include a diode, and one or more storage capacitors and a resistor to form the delay circuit.

In addition, an anti-sparking circuit including a capacitor, or other known anti-sparking circuitry may be coupled across the motor to further assist in preventing burn-out of the motors.

In accordance with another aspect of the invention, instead of an electromagnetic relay, operative at low voltages, a low voltage solid state switch may be employed to control the high voltage motor circuit.

Other objects, features and advantages of the invention will become apparent from a consideration of the following detailed description and from the accompanying drawings.

BRIEF DESCRIPTION OF THE DRAWINGS

FIG. 6 is a diagram indicating the electrical connections for the additional low voltage circuitry provided in accordance with the present invention;

DETAILED DESCRIPTION

Figure 1:
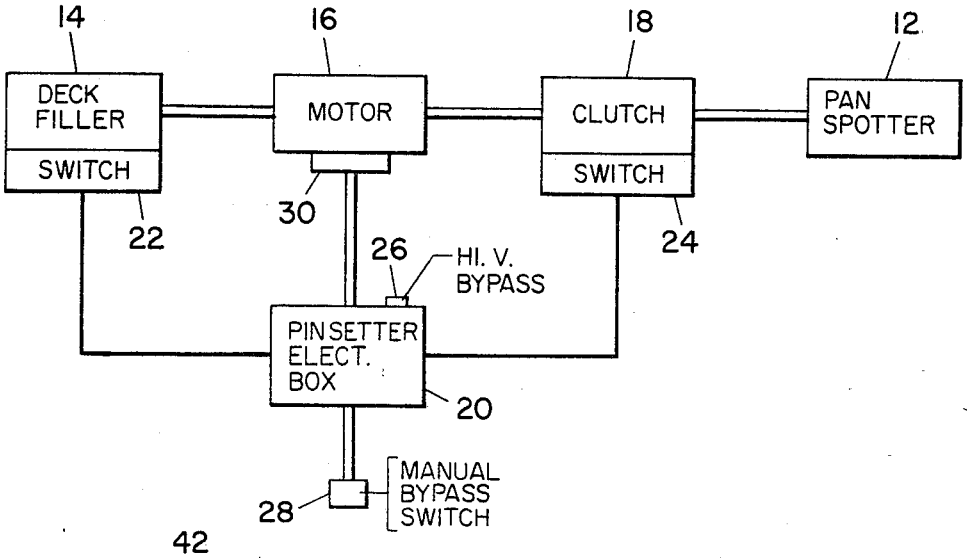
FIG. 1 is a block diagram illustrating a pinsetter system to which the present invention is applicable.

Referring more particularly to the invention, FIG. 1 is a block diagram of an automatic pinsetter such as that manufactured by the Brunswick Corporation. Such pinsetters have been widely sold by the Brunswick Corporation, and are described in the automatic pinsetter Service Manual, supplied by the Bowling Service Dept., of Brunswick Corp. of Muskegon, Mich.

Now, referring to the block diagram of FIG. 1, an automatic pinsetter normally includes a pinspotter 12 and a deck filler 14, which are operated under power supplied by a continuously operating motor 16. When a bowling ball comes down the alley, it actuates a switch which may be associated with the cushion which absorbs the impact of the ball, and this energizes the clutch 18 which couples the pinspotter 12 to the motor 16. The pinspotter goes through its cycle of operation, including sweeping the "deadwood" from the alley, and re-setting new pins when this is appropriate.

The pinspotter 12 has a "deck" including a series of receptacles for pins which are to be subsequently spotted on the alley; and the "deck filler" mechanism 14 which is normally continuously operated, picks up the loose pins at the rear of the alley and feeds them up into the deck associated with the pinspotter until the deck is filled.

As mentioned hereinabove, in the form that the automatic pinsetters are sold by companies such as Brunswick, the motor 16 runs continuously, and thus continuously operates the deck filler 14. Of course, the motor 16 is of a substantial size and, with electricity becoming more costly year by year, the continuous energization of the motor 16 is quite expensive. The present invention, as mentioned hereinabove, involves the use of a low voltage circuit which may be included within the standard pinsetter electrical box 20 and which includes a relay for turning the motor 16 on and off in accordance with signals provided from the switches 22 and 24 associated with the deck filler 14 and the clutch 18, respectively.

The motor 16 may also be operated directly by the actuation of the high voltage bypass switch 26. In addition, the relay which is controlled by switches 22 and 24 may also be operated by the manual bypass switch 28. With the motor 16 now being turned on and off quite frequently, a protective circuit 30 for avoiding damage to the relay when it is frequently turned on and off is provided.

The pinsetter motor 16 is a capacitive start type motor, and has a small housing, often on the top on newer motors, containing one or two capacitors, in the original installation. When the remainder of the present system is used, a relatively high resistor such as 15,000 ohms is connected across each of the capacitors, as indicated by block 30 in FIG. 1. This serves to bleed off the charge relatively rapidly, and helps avoid motor burnout which might otherwise occur when the motor is turned on and off more frequently, as the present system is used.

Now, turning to FIG. 2, this is the low voltage circuit which, when used in combination with the existing pinsetter apparatus of Brunswick, produces the economical and long lasting results as mentioned hereinabove. More specifically, the relay 36 includes a low voltage input circuit 38 which energizes relay 36 and closes the high voltage circuit 40 to the motor 16 as shown in FIG. 1. The high voltage manual by-pass switch 26 permits the direct energization of the motor 40 regardless of the state of any of the switches 44, 46 or 48, to be discussed in greater detail hereinbelow.

The terminal strip 50 provides a source of 24 volt alternating current to power the low voltage circuit which is attached to terminals 52 and 54 in positions 1 and 9 of the low voltage terminal strip 50. Now, the capacitors 56 and 58 together with the resistor 60 provide a storage or delay circuit to maintain the relay 36 energized for a period of time after the opening of all of the switches 22, 24 and 48. As noted above, this mode of operation permits the completion of the cycle of operation of the deck filler after the opening of the "full deck" switch 22. Incidentally, the diode 62 provides the direct current for charging up the capacitors 56 and 58, to maintain the relay 36 energized for the desired additional few seconds.

Figure 3:
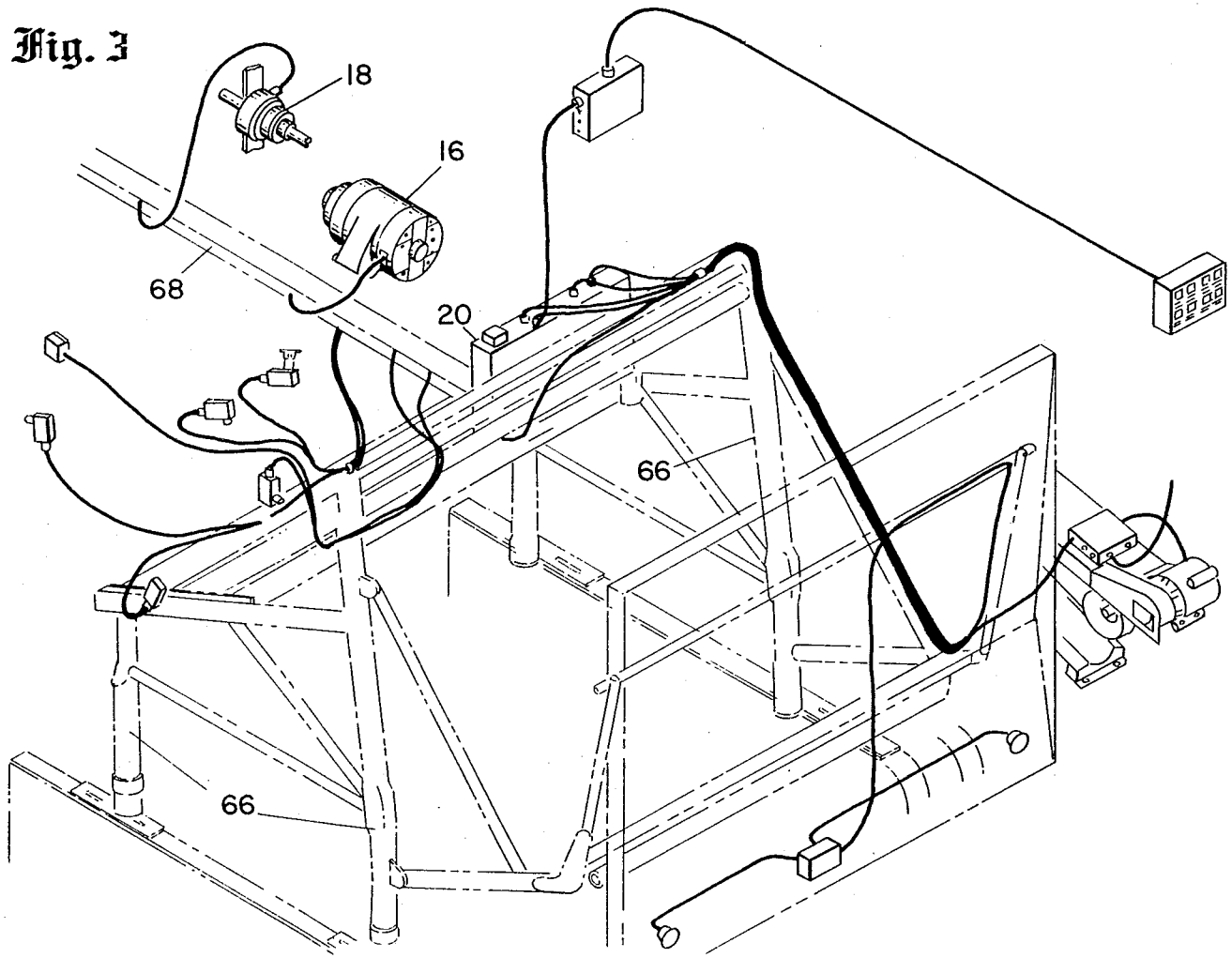
FIG. 3 is a diagram indicating the principal electrical components and wiring arrangements for a Brunswick automatic pinsetter.

FIG. 3 is a diagrammatic showing of the wiring for a Brunswick pinsetter. FIG. 3 corresponds to FIG. 61 included in the Brunswick automatic pinsetter Service Manual mentioned hereinabove. Particularly notable in FIG. 3 are the pinsetter motor 16 and the pinsetter electrical box 20, both of which were included in the block diagram of FIG. 1. Also visible in FIG. 3 are the frame members 66 of the pinsetter structure, and the wiring channel 68 through which the electrical control wires are directed. The clutch 18 is also shown toward the top of FIG. 3. Other circuit components not closely relevant to the present invention, also appear in FIG. 3 and are identified by legends. As a matter of interest, the bowling balls would normally be directed toward the pinsetter apparatus from the lower right-hand side to the upper left hand side in FIG. 3.

Figure 2:
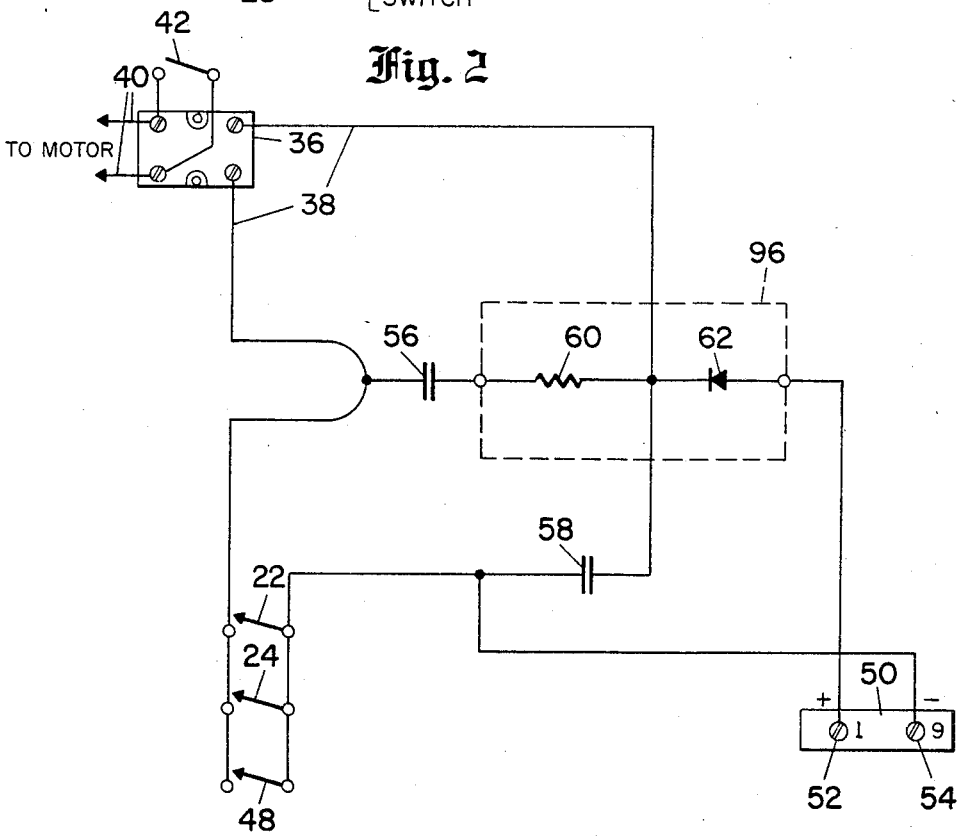
FIG. 2 is a circuit diagram of the low voltage control system which provides the intermittent operation of the pinsetter motor, illustrating the principles of the present invention.

Consideration will now be given to the location of the two switches 22 and 24 as shown in FIGS. 1 and 2. The switch 24 is implemented by a microswitch including an arm 72 which is mounted for actuation by the plunger lever 74 associated with the clutch 18 which as shown in FIG. 1 couples the pinsetter motor 16 to the pinspotter 12. Accordingly, as mentioned above, when a bowling ball is received at the pinsetter installation, and actuates a switch when the ball strikes the cushion, the clutch mechanism is actuated by an electromagnet, and this moves the plunger lever 74 to close the switch 24. The microswitch 24 is mounted on a bracket 76 which is provided with two holes 78 through which the bolts 80 (part of the original installation) extend. Incidentally, a more complete showing of this portion of the mechanical details of the pinsetter is included as FIG. 10 of the Brunswick Service Manual on pages 1–11 thereof.

Turning now to the location of the "full deck" switch 22, it may be implemented by a mercury switch mounted on a bracket arm 84, by which it is secured by hex nut 86 to the rotating rear interlock cross-shaft 88. This shaft 88 is rotated as the deck associated with the pinspotter is completely filled, thereby tilting the mercury switch 22 and opening it. As mentioned above, after a predetermined interval of time such as three or four seconds, while the cycle of the apparatus is completed, the relay 36 is operated, and the motor 16 is turned off.

Figure 7:
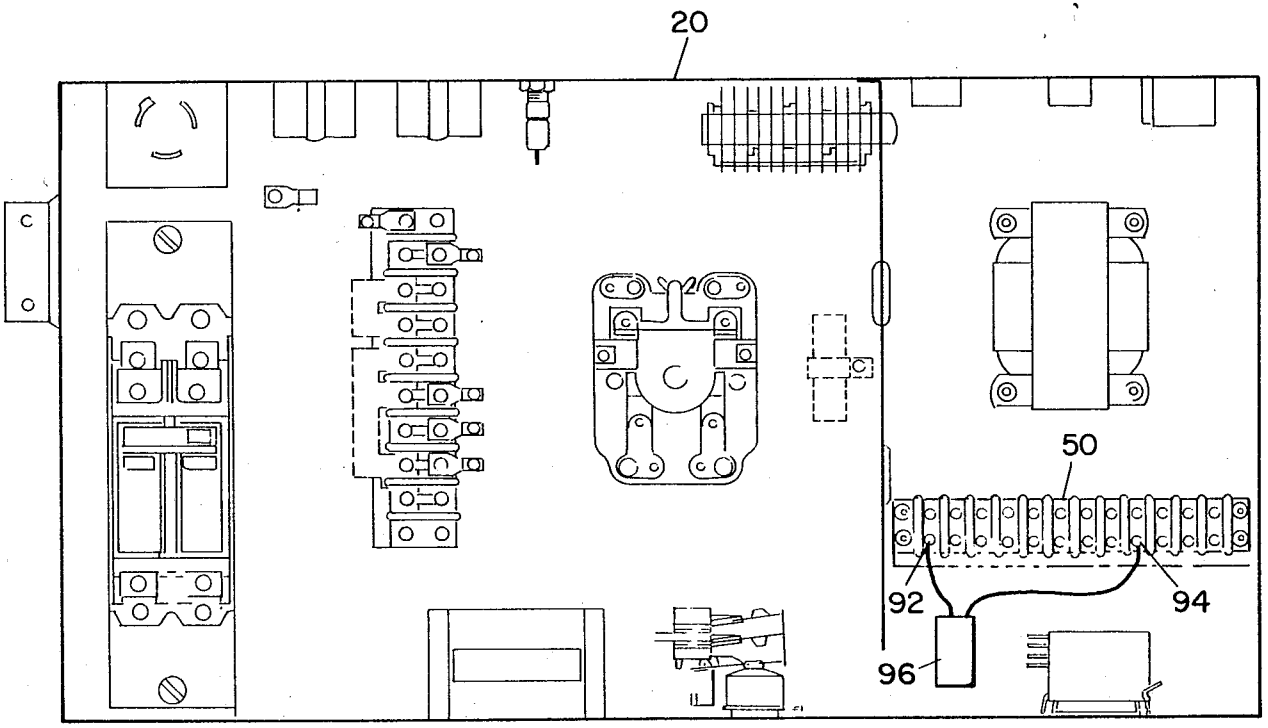
FIG. 7 is a diagram of the existing configuration of the electrical circuit box in a Brunswick automatic pinsetter.

FIGS. 6 and 7 show how the improved arrangements of the present invention are added to the pinsetter electrical box 20. FIG. 7 is a diagram of the electrical box of a type A-II Brunswick pinsetter machine. In the lower right-hand side of the box is the terminal strip 50, which also appears diagrammatically in FIG. 2 of the present drawings. 24 volts AC are available across Terminals Nos. 1 and 9 indicated at 92 and 94 in FIG. 7 (terminals 52 and 54 in FIG. 2). A commercially available control box 96, including the rectifier 62, the two capacitors 56 and 58, and the resistor 60 as shown in FIG. 2, are shown connected to terminals 92 and 94 of terminal strip 50 in FIGS. 6 and 7.

Figure 4:
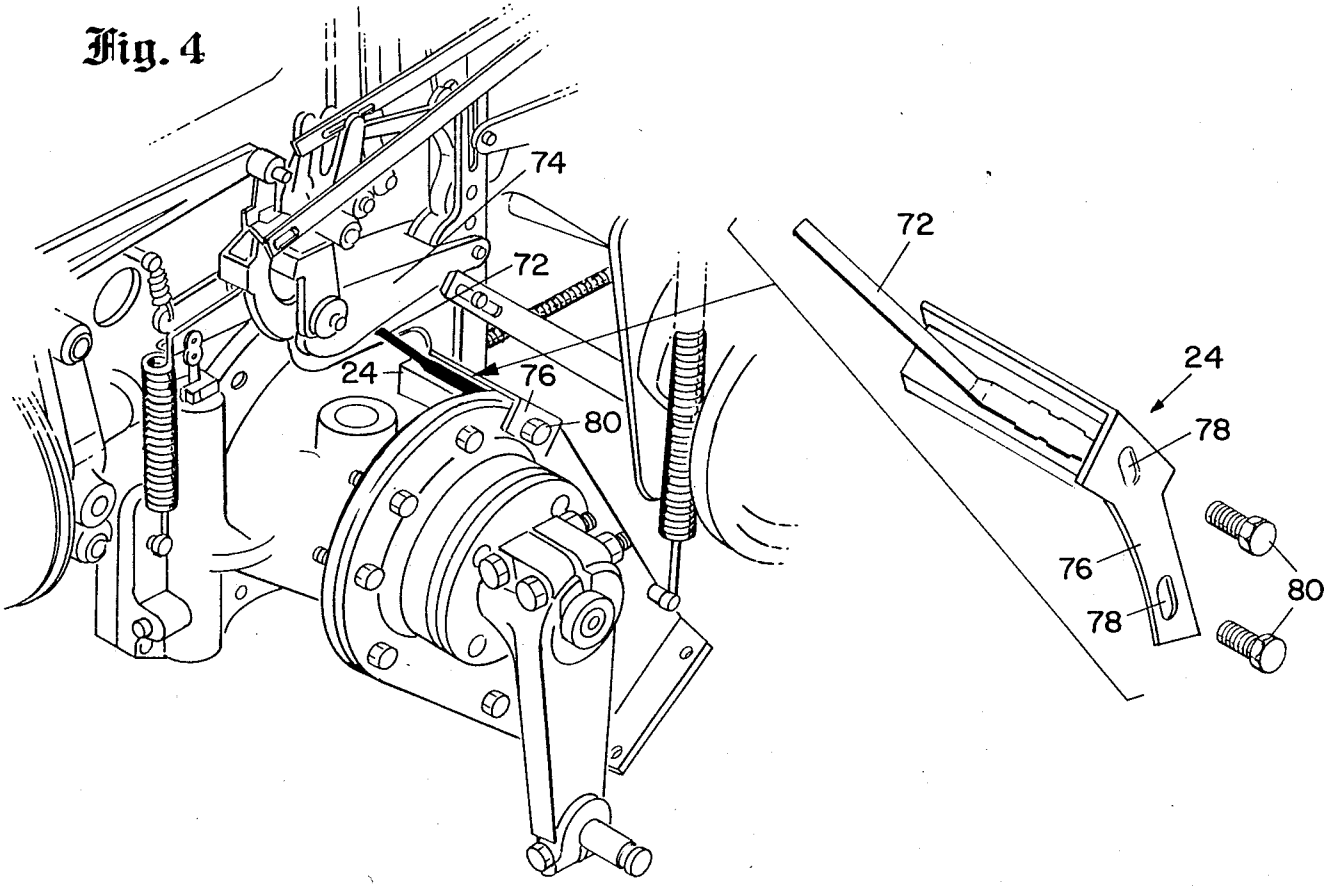
FIG. 4 is a diagram indicating the mounting location of the supplemental switch relating to the clutch operation.
Figure 5:
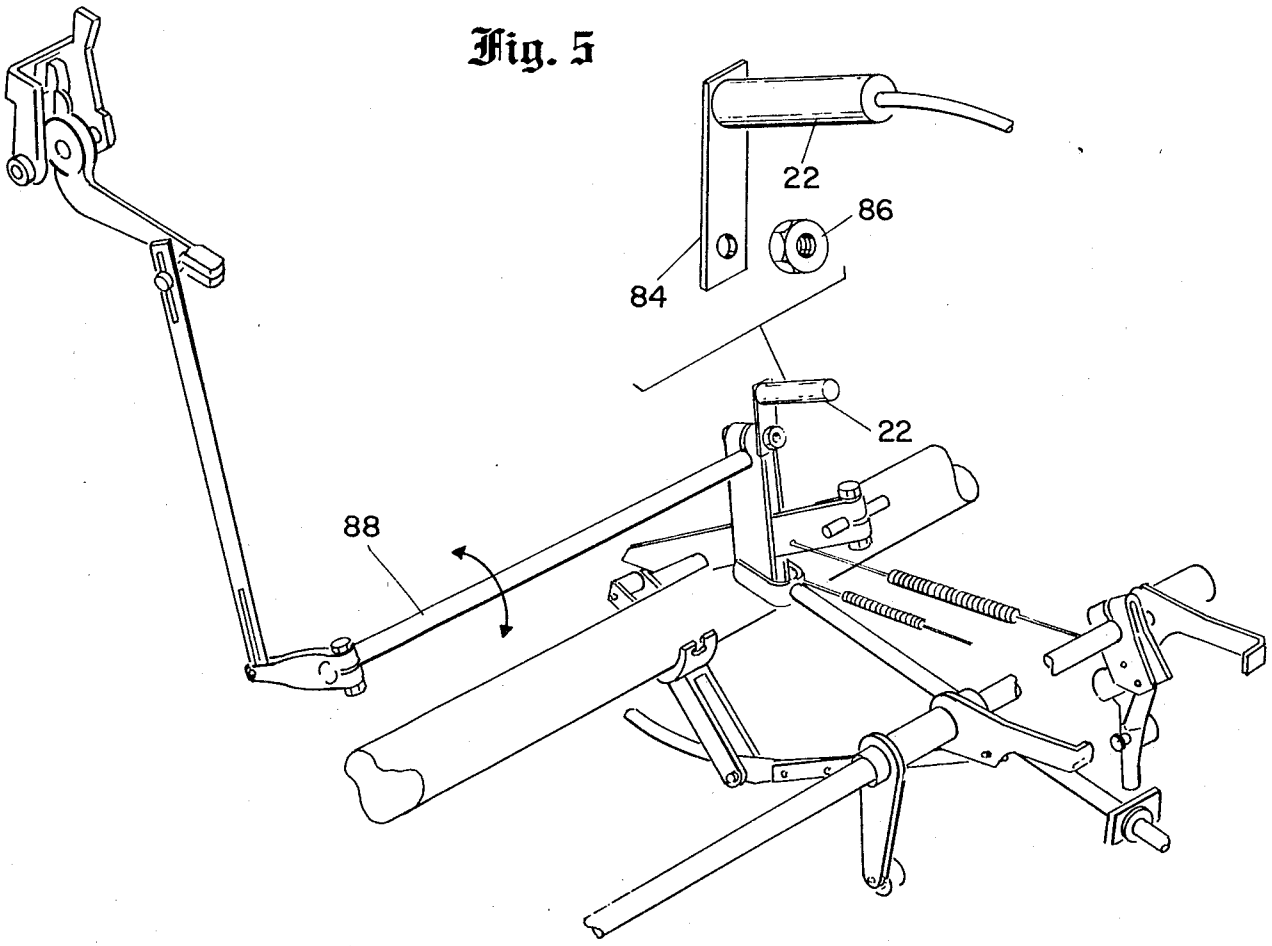
FIG. 5 is a diagram indicating the mounting location for the "full deck" switch employed in the present system.
Figure 5:
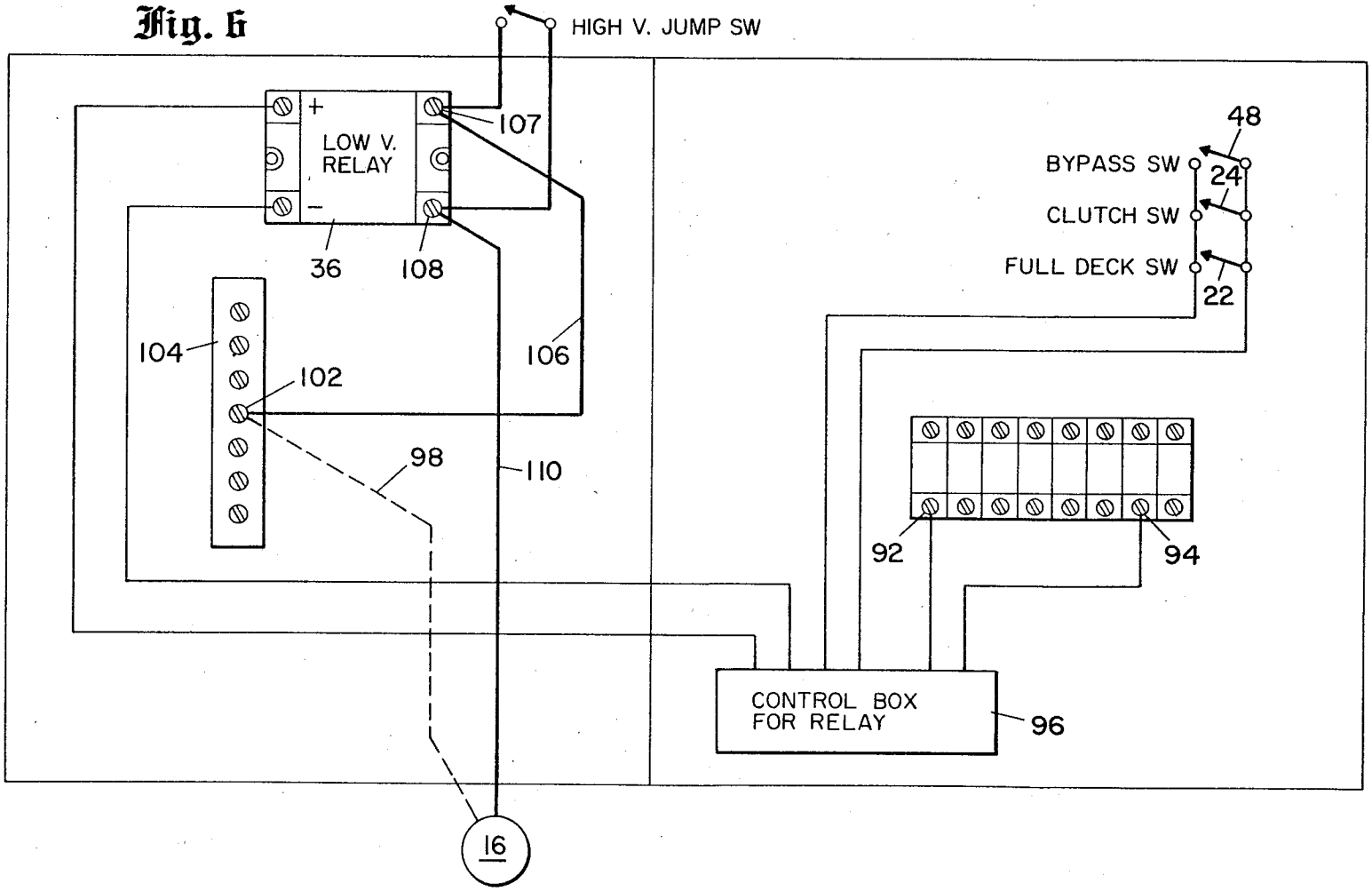

In FIG. 6, the original connection to the motor 16 is shown in dashed lines at 98, connected to terminal D, designated by reference numeral 102 of the high voltage terminal strip 104. Incidentally, the motor 16 operates at a relatively high voltage, nominally 220, volts AC, but actually in the order of 208 volts, in practice. With the new arrangement, terminal D is connected to one of the output terminals 104 of relay 36, by high voltage lead 106 and the motor 16 is connected directly to the other output terminal 108 of relay 36 by the high voltage lead 110. Of course, the relay 36 is new within the electrical junction box 20 and may be mounted to the junction box 20 in one of the convenient vacant spaces within the box. Similarly, the control box 96 is new, but this is very lightweight and can be readily mounted within the box 20, supported only by the associated connecting leads. The switches 22, 24 and 48 are mounted as discussed hereinabove in connection with FIGS. 4 and 5 of the drawings.

Figure 8:
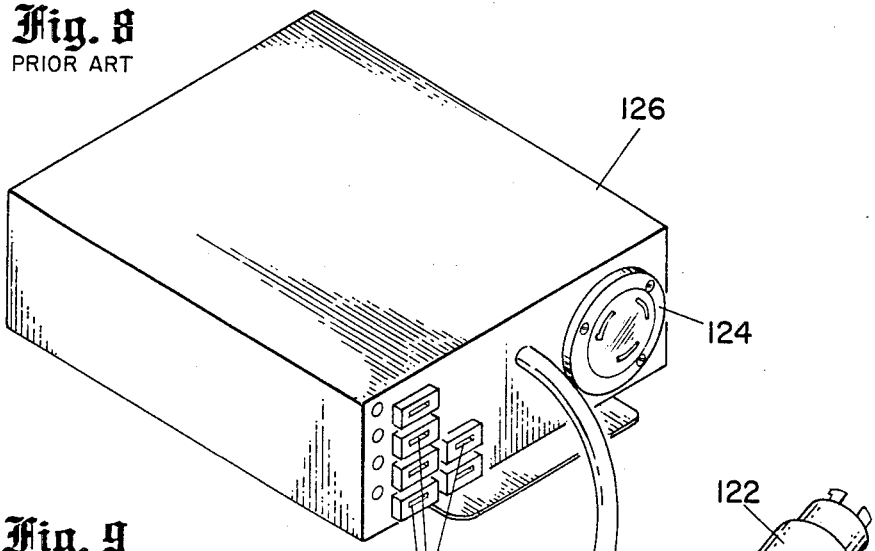
Fig. 8 PRIOR ART
FIG. 8 is a diagram of the supplemental electrical box which was employed in the commercial implementation of the arrangement mentioned hereinabove.
Figure 9:
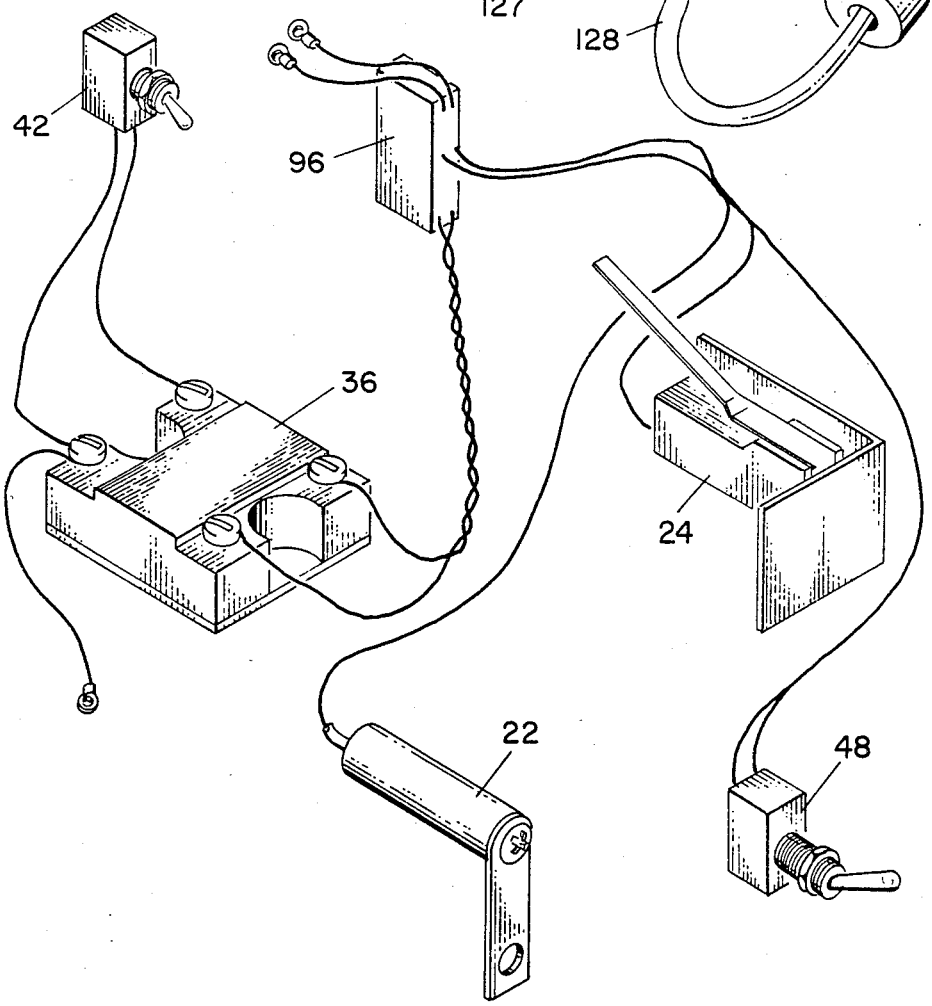
FIG. 9 shows the few and simple complete low voltage electrical circuits which are added to make the pinsetter system operate only when needed, and which illustrate the simplicity of the present invention.

FIGS. 8 and 9 are provided for comparison purposes to indicate graphically the differences between the prior art arrangements shown in FIG. 8 and the FIG. 9 showing of applicant's new low voltage circuitry which accomplishes the desired energy saving by intermittently operating the pinsetter motor. With regard to the system of FIG. 8 which was sold commercially the massive high voltage plug 122 and receptacle 124 may be noted. Other circuitry, are connected to terminals 127 on box 126. In addition, the metal box 126 used in that system has dimensions of about 3¾ inches by 7 inches by 8 inches.

By contrast, the small number of parts and wiring required to change over to the intermittent mode of operation in accordance with the low voltage system of the present invention, are shown in FIG. 9. It is estimated that the weight of the parts as shown in FIG. 9 is about equal to that of the length of cable of 128 and the receptacle 122 of the prior art arrangements shown in FIG. 8. It is contemplated that the parts as shown in FIG. 9 will be sold as a kit along with instructions for modification of existing systems. Incidentally, it may also be noted that, because of the serious burn-out problems which have been encountered hereinbefore with power systems which have been proposed, the present system has been under test for approximately 6 months, and it has operated perfectly, with no motor burn-out. On the other hand, persons who have employed the system as shown in FIG. 8 have encountered motor burn-out problems within relatively short periods of time, such as a month or two.

For completeness, it is noted that the following parts may be employed in the implementation of the invention:

(a) Relay 36—CryDom Part No. D2425
(b) Mercury Tilt Switch 22—Radio Shack Part No. 275-027
(c) High Voltage Toggle Switch 42—Radio Shack Part No. 275-027.
(d) Low Voltage Toggle Switch 48—Radio Shack Part No. 275-651.
(e) Resistor 60—4.7k. ohms, one-fourth watt—Radio Shack Part No. 275-602.
(f) Electrolytic Capacitor 56—47 microfarads, 35 volts, Radio Shack Part No. 272-1015.
(g) Electrolytic Capacitor 58—470 microfarads, 35 volts, Radio Shack Part No. 272-1018.
(h) Rectifier diode 62—Type 1-N-4001-50 Piv, Radio Shack Part No. 276-1101.
(i) Microswitch 24—Unimax Type 2HBT-1.
(j) Resistor in Spark Prevention Circuit 30—15,000 ohms, 2 watts.

The foregoing parts and values were employed in one operative unit which has been under successful test; however, it is to be understood that other parts may be employed to implement the indicated components.

In conclusion, it is to be understood that the foregoing detailed description and the accompanying drawings relate to one specific system illustrating the principles of the present invention. The principles as set forth herein can be applied to other pinsetter arrangements in addition to the Brusnwick System with which it has been described herein. In addition, instead of the specific circuit elements, other low voltage switches and delay circuits could be employed. By way of specific example, instead of using a low voltage electromagnetic relay as disclosed hereinabove, a solid state switching component may be employed. Accordingly, the present invention is not limited to that precisely as shown and described hereinabove.

What is claimed is:

1. A simplified, low voltage control circuit and system for addition to an original installation bowling alley pin-setter wherein the pin-setter includes:

(a) a pinspotter mechanism including a deck for holding bowling pins;
(b) deck filler means for supplying bowling pins to said deck;
(c) motor means for operating said pinspotter mechanism and for driving said deck filler;
(d) clutch means for selectively coupling said motor means to said pinspotter mechanism; and
(e) a pin-setter electrical box including both low voltage control circuitry, and high voltage circuitry for energizing said motor means;

wherein the improvement comprises:

relay means mounted in said original installation pinsetter electrical box, said relay means including output terminals included in said high voltage circutiry for turning said motor means on and off, and a low voltage input circuit for operating said relay means;

first switch means coupled for operation by said clutch means to operate said relay means from said low voltage control circuitry to turn said motor on when said clutch is actuated;

second switch means coupled to indicate when the deck filler means has filled said deck with bowling pins, for maintaining said relay means energized from said low voltage control circuitry to keep said motor means running unril said deck is full;

circuit means for coupling said switches to said low voltage control circuitry;

means mounted in said original installation pin-setter electrical box for delaying the operation of said relay following operation of said second switch means to continue operation of said motor for a few seconds to complete the cycle of operation of the system;

said low voltage control circuitry being energized with AC voltage, and rectifier means coupled between said low voltage control circuitry and said relay means; and said delaying means including at least one capacitor and resistor means for supplying current to said input circuit to said relay means from said capacitor after said switch means have opened;

whereby intermittent, energy saving operation of said motor means is achieved by the addition of a few inexpensive low voltage components included within the original installation pinsetter electrical box.

2. A simplified, low voltage control circuit and system as defined in claim 1 wherein said first switch means is a microswitch including an arm mounted for actuation by a mechanical linkage as said clutch is operated.

3. A simplified, low voltage control circuit and system as defined in claim 1 wherein said second switch means is a mercury switch, and means are provided for mounting it for rotation and selective operation when said deck is filled.

4. A simplified, low voltage control circuit and system as defined in claim 1 further comprising manual bypass switch means connected in parallel with said first and second switch means for actuating said relay means and operating said motor, independently of the state of said clutch means and said deck filler means.

5. A simplified, low voltage control circuit and system as defined in claim 1 further comprising antisparking circuit means coupled to the input to said motor to assist in preventing motor burn-out as said motor is turned on and off.

6. A system as defined in claim 1 further including manually operable switch means connected across the output terminals of said relay, whereby said motor means may be manually operated regardless of the state of the remainder of the system.

7. A simplified, low voltage control circuit and system for addition to an original installation bowling alley pin-setter wherein the pin-setter includes:

(a) a pinspotter mechanism including a deck for holding bowling pins;

(b) deck filler means for supplying bowling pins to said deck;

(c) motor means for operating said pinspotter mechanism and for driving said deck filler;

(d) clutch means for selectively coupling said motor means to said pinspotter mechanism; and (e) a pin-setter electrical box including both low voltage control circuitry, and high voltage circuitry for energizing said motor means;

wherein the improvement consists essentially of the following:

relay means mounted in said electrical box, said relay means including output terminals included in said high voltage circuitry for turning said motor means on and off, and a low voltage input circuit for operating said relay means;

first switch means coupled for operation by said clutch means to operate said relay means from said low voltage control circuitry to turn said motor on when said clutch is actuated;

second switch means coupled to indicate when the deck filler means has filled said deck with bowling pins, for maintaining said relay means energized from said low voltage control circuitry to keep said motor means running until said deck is full;

circuit means for coupling said switches to said low voltage control circuitry;

means included in the original installation pin-setter electrical box for delaying the operation of said relay following operation of said second switch means to continue operation of said motor for a few seconds to complete the cycle of operation of the system;

said low voltage control circuitry being energized with AC voltage, and rectifier means coupled between said low voltage control circuitry and said relay means; and said delaying means including at least one capacitor and resistor means for supplying current to said input circuit to said relay means from said capacitor after said switch means have opened;

whereby intermittent, energy saving operation of said motor means is achieved by the addition of a few inexpensive low voltage components.

* * * * *